US009392913B2

(12) United States Patent
Quinlan et al.

(10) Patent No.: US 9,392,913 B2
(45) Date of Patent: Jul. 19, 2016

(54) HORIZONTAL PUMPS WITH REDUCED PART COUNT, REFILL UNITS AND DISPENSERS

(71) Applicant: GOJO Industries, Inc., Akron, OH (US)

(72) Inventors: Robert L. Quinlan, Stow, OH (US); John J. McNulty, Broadview Heights, OH (US)

(73) Assignee: GOJO Industries, Inc., Akron, OH (US)

( * ) Notice: Subject to any disclaimer, the term of this patent is extended or adjusted under 35 U.S.C. 154(b) by 47 days.

(21) Appl. No.: 14/259,236

(22) Filed: Apr. 23, 2014

(65) Prior Publication Data

US 2014/0319180 A1 Oct. 30, 2014

Related U.S. Application Data

(60) Provisional application No. 61/815,926, filed on Apr. 25, 2013.

(51) Int. Cl.
*A47K 5/16* (2006.01)
*A47K 5/14* (2006.01)
(Continued)

(52) U.S. Cl.
CPC ... *A47K 5/16* (2013.01); *A47K 5/14* (2013.01); *B01F 3/04446* (2013.01);
(Continued)

(58) Field of Classification Search
CPC ..... A47K 5/14; A47K 5/16; B01F 3/04446; B01F 5/0691; B01F 5/0693; B05B 7/0037; B05B 11/3015; B05B 11/3064; B05B 11/3087
See application file for complete search history.

(56) References Cited

U.S. PATENT DOCUMENTS 2,904,222 A 9/1959 Philippe
3,851,801 A 12/1974 Roth
(Continued)

FOREIGN PATENT DOCUMENTS

CH 676227 A5 12/1990
EP 1147818 A1 10/2001
(Continued)

OTHER PUBLICATIONS

International Search Report and Written Opinion from International Application No. PCT/US2014/035072 date of mailing Jul. 23, 2014.
(Continued)

*Primary Examiner* — Nicholas J Weiss
(74) *Attorney, Agent, or Firm* — Calfee, Halter & Griswold LLP

(57) ABSTRACT

Exemplary embodiments of foam pumps, refill units and dispenser systems are disclosed herein. Some embodiments have a foam pump that includes a valve cavity housing with a liquid inlet. A unitary valve body is located within the valve cavity housing. The unitary valve body includes a liquid inlet wiper valve, a liquid outlet wiper valve, a hollow interior portion, an opening through the valve body into the hollow interior portion, and an outlet opening. The foam pump also includes a pump chamber and a pump chamber opening through the valve cavity. The pump chamber opening is located between the liquid inlet wiper valve and the liquid outlet wiper valve. An air inlet into the valve cavity housing is also included. The valve cavity includes a mixing chamber. A mix media and foam outlet are included. The foam pump may be connected to a container to form a refill unit.

15 Claims, 3 Drawing Sheets

(51) Int. Cl.

| | |
|---|---|
| ***B05B 7/00*** | (2006.01) |
| ***B05B 11/00*** | (2006.01) |
| ***B01F 5/06*** | (2006.01) |
| ***B01F 3/04*** | (2006.01) |

(52) U.S. Cl.
CPC ..... *B01F 5/0691* (2013.01); *B01F 5/0693* (2013.01); *B05B 7/0037* (2013.01); *B05B 11/3015* (2013.01); *B05B 11/3064* (2013.01); *B05B 11/3087* (2013.01)

(56) References Cited

U.S. PATENT DOCUMENTS

| | | | | |
|---|---|---|---|---|
| 3,952,924 | A * | 4/1976 | Benson | G01F 11/08 222/181.2 |
| 4,168,020 | A | 9/1979 | Benson | |
| 4,330,071 | A | 5/1982 | Ohlson | |
| 4,793,522 | A | 12/1988 | Corsette | |
| 4,880,161 | A | 11/1989 | Wright | |
| 4,986,453 | A | 1/1991 | Lina et al. | |
| 5,271,530 | A | 12/1993 | Uehira et al. | |
| 5,439,140 | A | 8/1995 | Meyer | |
| 5,445,288 | A | 8/1995 | Banks | |
| 5,462,208 | A | 10/1995 | Stahley et al. | |
| 5,826,755 | A | 10/1998 | Burd | |
| 5,862,954 | A | 1/1999 | Ehrensperger | |
| 5,899,363 | A | 5/1999 | Bliss, III et al. | |
| 5,906,299 | A | 5/1999 | Hagleitner | |
| 6,065,647 | A | 5/2000 | Bliss, III et al. | |
| 6,446,840 | B2 | 9/2002 | Ophardt et al. | |
| 6,971,549 | B2 | 12/2005 | Leifheit et al. | |
| 7,059,282 | B2 | 6/2006 | Vorih et al. | |
| 7,377,758 | B2 | 5/2008 | Sallows et al. | |
| 7,815,076 | B2 | 10/2010 | Ophardt | |
| 8,360,287 | B2 * | 1/2013 | Ciavarella | A47K 5/14 222/209 |
| 8,528,792 | B2 * | 9/2013 | Ophardt | B05B 11/007 222/181.2 |
| 8,579,159 | B2 | 11/2013 | Ciavrella | |
| 2003/0000967 | A1 | 1/2003 | Ehrensperger | |
| 2004/0031816 | A1 | 2/2004 | Schuman | |
| 2006/0273114 | A1 | 12/2006 | Ophardt | |
| 2008/0272148 | A1 | 11/2008 | Malik et al. | |
| 2009/0308894 | A1 * | 12/2009 | Ophardt | A47K 5/1211 222/190 |
| 2010/0096412 | A1 | 4/2010 | Law | |
| 2011/0079614 | A1 | 4/2011 | Ganzeboom et al. | |
| 2013/0315031 | A1 | 11/2013 | Bunoz et al. | |

FOREIGN PATENT DOCUMENTS

| | | | |
|---|---|---|---|
| EP | 2080464 | A2 | 7/2009 |
| EP | 2080560 | A1 | 7/2009 |
| GB | 1269545 | | 4/1972 |
| GB | 2301812 | | 12/1996 |
| GB | 2472235 | | 2/2011 |
| WO | 2011157975 | A1 | 12/2011 |

OTHER PUBLICATIONS

European Patent Office Search Report issued Jan. 7, 2011 in EP Application No. 09 150 800.2; 4 pages.

International Search Report and Written Opinion from International Application No. PCT/US2013/056106, date of mailing Nov. 7, 2013; 10 pages.

International Search Report and Written Opinion from International Application No. PCT/US2013/067158, date of mailing Apr. 11, 2014; 16 pages.

International Search Report and Written Opinion from International Application No. PCT/US2013/067366, date of mailing Apr. 11, 2014; 18 pages.

International Search Report and Written Opinion from International Application No. PCT/US2013/056964, date of mailing Nov. 7, 2013; 12 pages.

International Search Report and Written Opinion from International Application No. PCT/US2013/056549, date of mailing Jan. 15, 2014; 16 pages.

* cited by examiner

HORIZONTAL PUMPS WITH REDUCED PART COUNT, REFILL UNITS AND DISPENSERS

RELATED APPLICATIONS

This application claims priority to and the benefits of U.S. Provisional patent application Ser. No. 61/815,926 filed on Apr. 25, 2013 and entitled HORIZONTAL PUMPS WITH REDUCED PART COUNT, REFILL UNITS AND DISPENSERS, and which is incorporated herein by reference in its entirety.

TECHNICAL FIELD

The present invention relates generally to pumps, refill units for dispensers, and dispensers, and more particularly to horizontal pumps with reduced part count, refill units and dispensers.

BACKGROUND OF THE INVENTION

Liquid dispensers, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Many dispensers are refillable with refill units that comprise a pump (or a pump and an air compressor) and a container. The refills are disposable when the liquid held within the refill unit is emptied. The components of the refill units and pumps are manufactured on one station and then assembled at another station. Accordingly, the more parts utilized in the pump, the more costly the pump is to manufacture.

SUMMARY

Exemplary embodiments of foam pumps, refill units and dispenser systems are disclosed herein. Some embodiments have a foam pump that includes a valve cavity housing. The valve cavity housing includes a liquid inlet. A unitary valve body is located within the valve cavity housing. The unitary valve body includes a liquid inlet wiper valve, a liquid outlet wiper valve, a hollow interior portion, an opening through the valve body into the hollow interior portion, and an outlet opening. The foam pump also includes a pump chamber and a pump chamber opening through the valve cavity. The pump chamber opening is located between the liquid inlet wiper valve and the liquid outlet wiper valve. The pump chamber opening places the interior of the valve cavity housing in fluid communication with the interior of the pump chamber. An air inlet into the valve cavity housing is also included. The valve cavity includes a mixing chamber. A mix media is located downstream of the mixing chamber. The foam pump further includes an outlet nozzle. The foam pump may be connected to a container to form a refill unit and the refill unit may be inserted into a dispenser to form a dispensing system.

Another exemplary foam pump includes a valve cavity housing that includes a liquid inlet in the valve cavity housing. A unitary valve body is located within the valve cavity housing. The unitary valve body includes a liquid inlet wiper valve and a liquid outlet wiper valve. A pump chamber and a pump chamber opening through the valve cavity are also included. The pump chamber opening is located between the liquid inlet wiper valve and the liquid outlet wiper valve and places the interior of the valve cavity housing in fluid communication with the interior of the pump chamber. An air inlet into the valve cavity housing is also included. A mixing chamber is located at least partially within the valve cavity. The foam pump also includes mix media located downstream of the mixing chamber and an outlet nozzle.

Another exemplary pump includes a valve cavity housing having a liquid inlet in the valve cavity housing. A unitary valve body located within the valve cavity housing. The unitary vale body includes a liquid inlet wiper valve, a liquid outlet wiper valve, a hollow interior portion, an opening through the valve body into the hollow interior portion, and an outlet opening. The pump includes a pump chamber and a pump chamber opening through the valve cavity. The pump chamber opening is located between the liquid inlet wiper valve and the liquid outlet wiper valve. The pump chamber opening places the interior of the valve cavity housing in fluid communication with the interior of the pump chamber. The pump includes an outlet nozzle.

BRIEF DESCRIPTION OF THE DRAWINGS

These and other features and advantages of the present invention will become better understood with regard to the following description and accompanying drawings in which.

DETAILED DESCRIPTION

Figure 1:
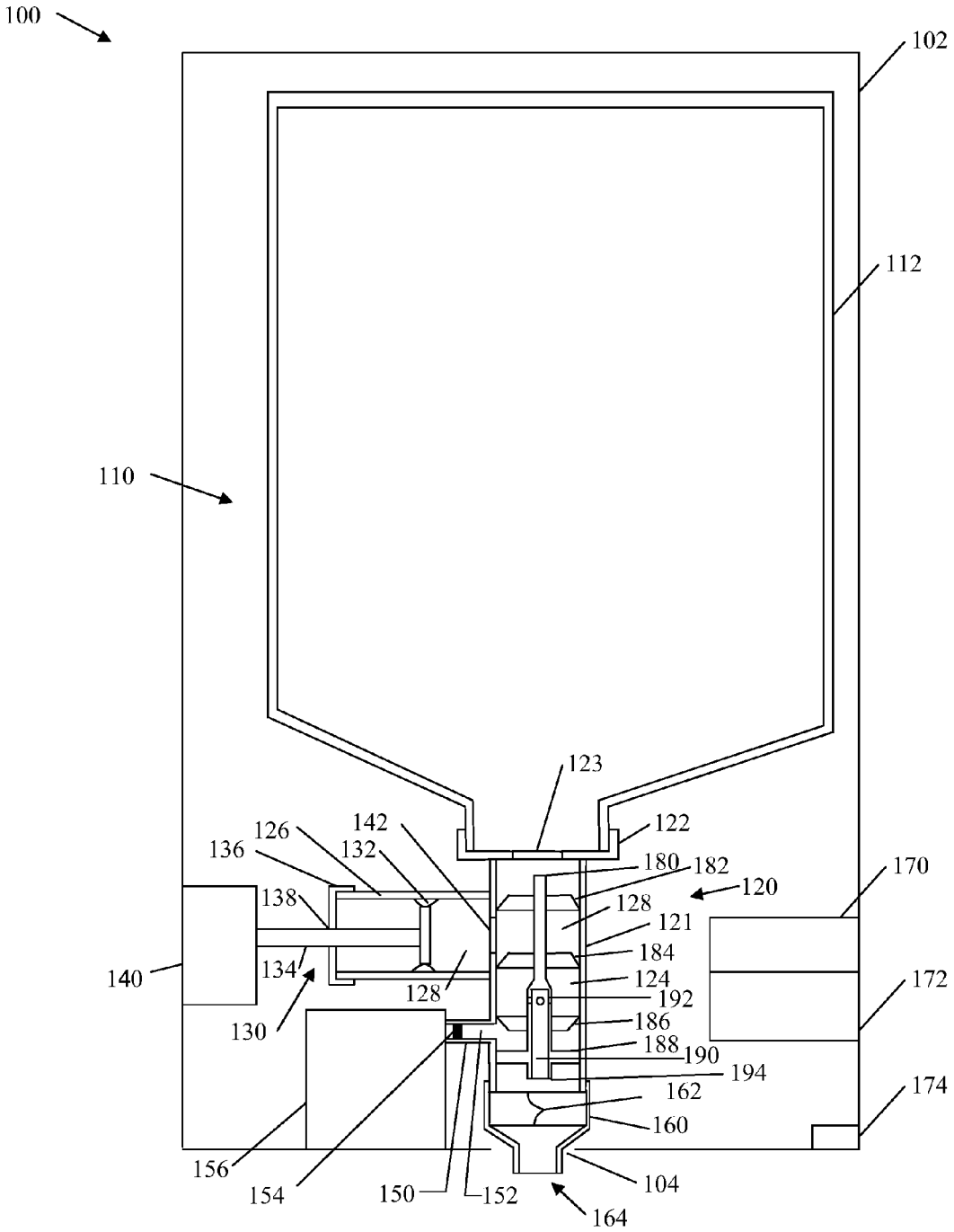
FIG. 1 is a cross-section of an exemplary dispenser having a refill unit with a foam pump installed.

FIG. 1 illustrates an exemplary embodiment of a foam dispenser 100. Foam dispenser 100 includes a housing 102 and a disposable refill unit 110. The disposable refill unit 110 includes container 112 connected to foam pump 120. Foam dispenser 100 may be a wall-mounted dispenser, a counter-mounted dispenser, a portable dispenser movable from place to place or any other kind of foam dispenser.

The container 112 forms a liquid reservoir that contains a supply of a foamable liquid within the disposable refill unit 110. In various embodiments, the contained liquid could be for example a soap, a sanitizer, a cleanser, a disinfectant or some other liquid that may be foamable or not foamable. In some embodiments, a liquid pump is used, and in such embodiments, the liquid need not be foamable.

In the exemplary disposable refill unit 110, the container 112 is a collapsible container and is made of thin plastic or plastic-like material. In some embodiments, the container 112 may be non-collapsible during use, or may have another suitable configuration for containing the foamable liquid without leaking. In the event that a non-collapsible container 112 is used, a vent (not shown) may be used to vent the container 112 as liquid is removed from the container 112. The container 112 may advantageously be refillable, replaceable or both refillable and replaceable.

In the event the liquid in the container 112 of the installed disposable refill unit 110 runs out, or the installed refill unit 110 otherwise has a failure, the installed refill unit 110 may be removed from the foam dispenser 100. The empty or failed disposable refill unit 110 may then be replaced with a new disposable refill unit 110.

Dispenser 100 is a touch-free dispenser and is electronically activated. The dispenser includes a housing 102. Located at least partially within housing 102 is a liquid pump actuator 140, an air compressor 156, circuitry 170, a power supply 172 and an object sensor 174. Actuator 140 is generically illustrated because there are many different kinds of actuators which may be employed in the foam dispenser 100. Similarly, air compressor 156, circuitry 170 are generically illustrated because many different types and configurations of these components may be used and these components are known by those skilled in the art. In addition, power supply 172 may be one or more batteries, an alternating current source and a transformer, or the like. Housing 102 also includes an aperture 104 located in the bottom for allowing foam to be dispensed to an object (not shown) below.

Although dispenser 100 is a touch-free dispenser, the dispenser may be a manual dispenser and the actuator for actuating the liquid piston 130 and air compressor 156 may a manual type actuator such as, for example, a manual lever, a manual pull bar, a manual push bar, a manual rotatable crank, a mechanically/electrically-activated actuator or other means for actuating the liquid piston 130 and air compressor 156.

Air compressor 156 is permanently secured to housing 102 and remains with the housing 102 when refill unit 110 is removed or replaced. The term "permanently secured" is used because the air compressor 156 remains with the dispenser when the refill unit 110 is removed. It is possible to remove and replace air compressor 156 if air compressor 156 fails over time. Thus, permanently secured means the air compressor 156 is not routinely removed and replaced with each refill.

Foam pump 120 includes a closure 122 for connecting foam pump 120 to container 112. Closer 122 may be connected to container 112 by any means, such as, for example, a snap fit connection, a threaded connection, an adhesive connection, a welded connection or the like. Closure 122 includes a liquid inlet aperture 123. Foam pump 120 also includes a valve cavity housing 121 secured to closure 122. Valve cavity housing 121 is at least partially cylindrical.

Extending outward from valve cavity housing 121 is liquid pump cavity housing 126. Liquid pump cavity housing 126 is cylindrical and extends along a horizontal axis. A pump cavity aperture 142 is located through the wall of valve cavity housing 121 placing the interior of liquid pump cavity housing 126 in fluid communication with the interior of valve cavity housing 121 to form a pump chamber 128.

In addition, a cylindrical air inlet housing 150 extends outward from valve cavity housing 121. Located within cylindrical air inlet housing 150 is a passageway 152 to the interior of valve cavity housing 121.

A filter 154 may be included in passageway 152. Filter 154 may be sized, for example, to prevent mold or bacteria in air compressor 156 from being injected into foam pump 120. A releasable connection (not shown) is used to fluidly connect air passage 152 with the outlet of air compressor 156. The releasable connection allows refill unit 110 to be removed and replaced without removing the air compressor 156 from dispenser housing 102. When the refill unit 110 is installed in housing 102, the air inlet passage 152 connects to the outlet of air compressor 156. Preferably closure 122, valve cavity housing 121, liquid pump cavity housing 126, air inlet housing 150 are made as a single molded piece. However, these components could be made of two or more components.

A valve body 180 is located within valve cavity housing 121. Valve body 180 is stationary and does not move up and down during operation of foam pump 120. Valve body 180 includes a liquid inlet wiper valve 182, a liquid outlet wiper valve 184, an air inlet wiper valve 186 and a stabilizing ring 188. The area between liquid inlet wiper valve 182, liquid outlet wiper valve 184 and piston 130, including the interior of pump housing 126 form liquid pump chamber 128. The area between liquid outlet wiper valve 186 and air inlet wiper valve 186 form a mixing chamber. Valve body 180 includes an hollow interior portion 190 and one or more apertures 192 that connect the hollow interior portion 190 to the mixing chamber 124.

Stabilizing ring 188 holds valve body 180 in place and also forms a seal between valve body 180 and valve cavity housing 121. Although one stabilizing ring 188 is shown and described herein, embodiments without a stabilizing ring may be used. In addition, in some embodiments, valve bodies having a plurality of stabilizing rings are used. In some embodiments, one or more stabilizing rings have apertures therethrough and allow fluid to freely flow through the stabilizing ring. In other embodiments, the stabilizing ring 188 forms a barrier that prevents fluid from passing by the stabilizing ring 188.

Foam pump 120 also includes an outlet nozzle 160. Outlet nozzle 160 is secured to valve cavity housing 121. Outlet nozzle 160 may be secured to valve cavity housing 121 by any means, such as, for example, a snap-fit connection, a threaded connection, an adhesive connection, a friction-fit connection, a welded connection, or the like. Outlet nozzle 160 includes one or more mix media 162. Mix media 162 may be screens (as illustrated), other porous members or baffles that agitate the liquid air mixture to create foam.

During operation, the liquid pump chamber 128 is primed by the liquid pump actuator moving piston 130 outward to expand liquid pump chamber 128. In some embodiments, a biasing member (not shown), such as, for example, a spring, is used to move piston 130 outward to expand liquid pump chamber 128. As pump chamber 128 expands, liquid is drawn in past liquid inlet wiper vale 182 into pump chamber 128. Once liquid pump chamber 128 is primed, the foam pump 120 is ready for to dispense. When an object is detected by object sensor 174, circuitry 170 provides power from power source 172 to actuator 140, which moves piston 130 inward. Liquid inlet wiper valve 182 prevents liquid from flowing back into container 112 and the liquid from liquid pump chamber 128 is forced to flow past liquid outlet wiper valve 184 into mixing chamber 124.

Air from air compressor 156 travels through filter 154, which may remove mold and/or bacteria from the air stream, through air inlet passage 152 past air inlet wiper valve 186 and into mixing chamber 124. Air inlet wiper valve 186 allows air to flow into mixing chamber 124 and prevents liquid from traveling back through air inlet passage 152 and contacting the air compressor 156 which remains with the dispenser 100 when the refill unit is removed. The air and liquid mix together to form a mixture that is forced through the one or more apertures 192 into the interior of valve body 180. The liquid air mixture flows out of the open end 194 of valve body 180 through the mix media 162 and is dispensed out of outlet 164 in the form of a foam.

Figure 2:
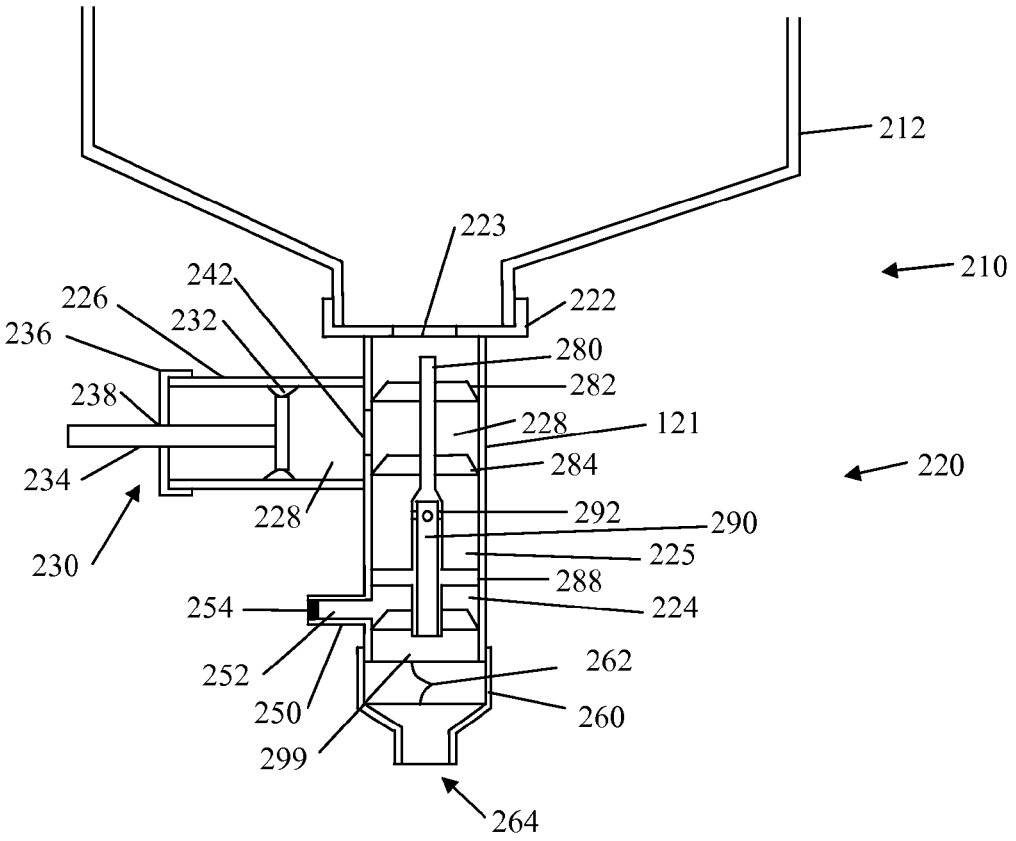
FIG. 2 is a partial cross-section of another refill unit with yet another exemplary foam pump.

FIG. 2 is a cross-sectional view of an exemplary embodiment of a refill unit 210 suitable for use in foam dispensers, such as foam dispenser 100. Foam pump 220 includes a closure 222 for connecting foam pump 220 to container 212. Closer 222 may be connected to container 212 by any means, such as, for example, a snap fit connection, a threaded connection, an adhesive connection, a welded connection or the like. Closure 222 includes a liquid inlet aperture 223. Foam pump 220 also includes a valve cavity housing 221 secured to closure 222. Valve cavity housing 221 is at least partially cylindrical.

Extending outward from valve cavity housing 221 is liquid pump cavity housing 226. Liquid pump cavity housing 226 is cylindrical and extends along a horizontal axis. A pump cavity aperture 242 is located through the wall of valve cavity housing 221 placing the interior of liquid pump cavity housing 226 in fluid communication with the interior of valve cavity housing 221 to form pump chamber 228.

In addition, a cylindrical air inlet housing 250 extends outward from valve cavity housing 221. Located within cylindrical air inlet housing 250 is a passageway 252 to the interior of valve cavity housing 221.

A filter 254 may be included in passageway 252. Filter 254 may be sized, for example, to prevent mold or bacteria in air compressor 256 from being injected into foam pump 220. A releasable connection (not shown) is used to fluidly connect air passage 252 with the outlet of air an air compressor, such as, for example, air compressor 156. The releasable connection allows refill unit 110 to be removed and replaced without removing the air compressor (not shown) from the dispenser housing (not shown). When the refill unit 210 is installed in a dispenser, the air inlet passage 252 connects to the outlet of an air compressor (not shown). Preferably closure 222, valve cavity housing 221, liquid pump cavity housing 226, air inlet housing 250 are made as a single molded piece. However, these components could be made of two or more components.

A valve body 280 is located within valve cavity housing 221. Valve body 280 is stationary and does not move up and down during operation of foam pump 220. Valve body 280 includes a liquid inlet wiper valve 282, a liquid outlet wiper valve 284, an air inlet wiper valve 286 and a stabilizing ring 288. Valve body 280 includes an hollow interior portion 290 and one or more apertures 292 that connect the hollow interior portion 290 to the mixing chamber 296. Valve body 280 also includes a liquid outlet 299. The area between liquid inlet wiper valve 282, liquid outlet wiper valve 284 and piston 230, including the interior of pump housing 226 form liquid pump chamber 228. The area between liquid outlet wiper valve 286 and stabilizing ring 288 is a liquid staging area 225. The area between the liquid outlet 299, air inlet wiper valve 286 and mix media 262 form a mixing chamber 224.

Stabilizing ring 288 holds valve body 280 in place and also forms a seal between valve body 280 and valve cavity housing 221. Stabilizing ring 288 seals the upper portion of valve cavity housing 221 from air and prevents fluid from the liquid staging area from traveling down into the air inlet passage 252.

Foam pump 220 also includes an outlet nozzle 260. Outlet nozzle 260 is secured to valve cavity housing 221. Outlet nozzle 260 may be secured to valve cavity housing 221 by any means, such as, for example, a snap-fit connection, a threaded connection, an adhesive connection, a friction-fit connection, a welded connection, or the like. Outlet nozzle 260 includes one or more mix media 262 and an outlet 264. Mix media 262 may be screens (as illustrated) or other porous members or baffles that agitate the liquid air mixture to create foam.

During operation, the liquid pump chamber 228 is primed by moving piston 230 outward to expand liquid pump chamber 228. In some embodiments, a biasing member (not shown), such as, for example, a spring, is used to move piston 230 outward to expand liquid pump chamber 228. As pump chamber 228 expands, liquid is drawn into pump chamber 228 past liquid inlet valve 282. Once liquid pump chamber 228 is primed, the foam pump 220 is ready for to dispense. Piston 230 is moved inward. Liquid inlet wiper valve 282 prevents liquid from flowing back into container 212 and the liquid from liquid pump chamber 228 is forced to flow past liquid outlet wiper valve 284 into the liquid staging area 225, through apertures 292 into the interior of valve body 280, through outlet 299 and into mixing chamber 244.

Air from an air compressor (not shown) travels through filter 254, which may remove mold and/or bacteria from the air stream, through air inlet passage 252 past air inlet wiper valve 286 and into mixing chamber 244. Air inlet wiper valve 286 allows air to flow into mixing chamber 224 and prevents liquid from traveling through air inlet passage 252 and contacting the air compressor (not shown) that is not removed when the refill unit is removed.

The air and liquid mix together to form a mixture that is forced through the mix media 262 and is dispensed out of outlet 264 in the form of a foam. In some embodiments, the liquid is moved into the mixing chamber 224 prior to the air being forced into mixing chamber 224. In some embodiment, the air and liquid are simultaneously injected into the mixing chamber 224. In some embodiments, the timing is offset and the start of the air being injected into the mixing chamber 224 lags the start of the liquid being injected into the mixing chamber 224.

Figure 3:
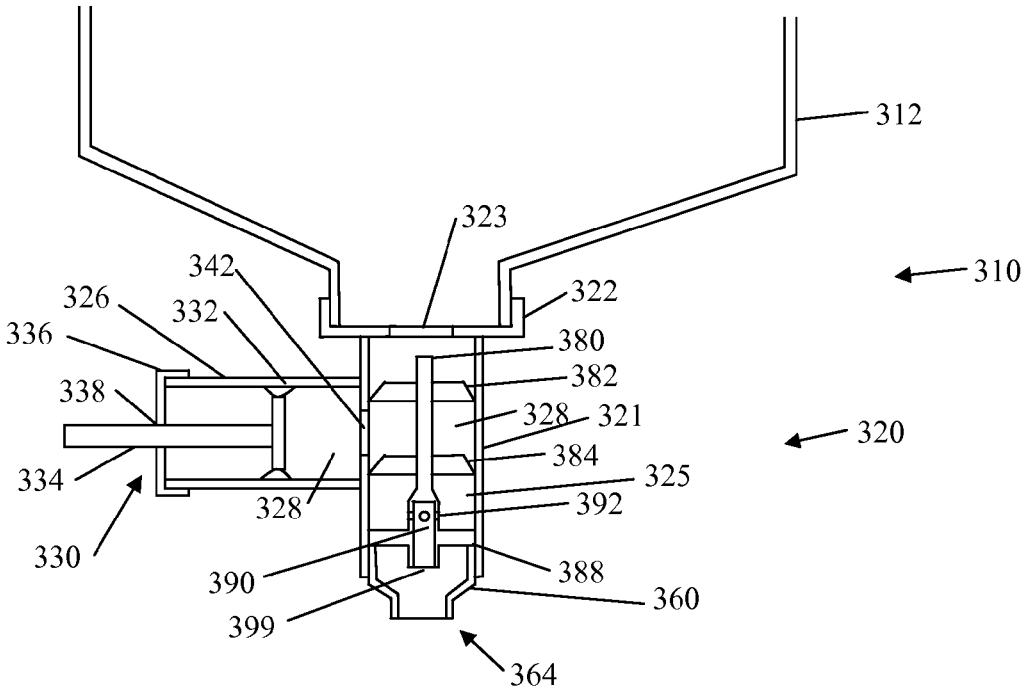
FIG. 3 is a partial cross-section of another refill unit with yet another exemplary liquid pump.

FIG. 3 is a cross-sectional view of an exemplary embodiment of a refill unit 310 suitable for use in liquid dispensers. Liquid pump 320 includes a closure 322 for connecting liquid pump 320 to container 312. Closer 322 may be connected to container 312 by any means, such as, for example, a snap fit connection, a threaded connection, an adhesive connection, a welded connection or the like. Closure 322 includes a liquid inlet aperture 323. Liquid pump 320 also includes a valve cavity housing 321 secured to closure 322. Valve cavity housing 321 is at least partially cylindrical.

Extending outward from valve cavity housing 321 is liquid pump cavity housing 326. Liquid pump cavity housing 326 is cylindrical and extends along a horizontal axis. A pump cavity aperture 342 is located through the wall of valve cavity housing 321 placing the interior of liquid pump cavity housing 326 in fluid communication with the interior of valve cavity housing 321 to form pump chamber 328.

A valve body 380 is located within valve cavity housing 321. Valve body 380 is stationary and does not move up and down during operation of liquid pump 320. Valve body 380 includes a liquid inlet wiper valve 382, a liquid outlet wiper valve 384 and a stabilizing ring 288. Valve body 380 includes an hollow interior portion 390 and one or more apertures 392 that connect the hollow interior portion 390 to a liquid staging area 325. Valve body 380 also includes a liquid outlet 399. The area between liquid inlet wiper valve 382, liquid outlet wiper valve 384 and piston 330, including the interior of pump housing 326 form liquid pump chamber 328. The area between liquid outlet wiper valve 386 and stabilizing ring 388 is a liquid staging area 325. Stabilizing ring 388 holds valve body 380 in place and also forms a seal between valve body 380 and valve cavity housing 321.

Liquid pump 320 also includes an outlet nozzle 360. Outlet nozzle 360 is secured to valve cavity housing 321. Outlet nozzle 360 may be secured to valve cavity housing 321 by any means, such as, for example, a snap-fit connection, a threaded connection, an adhesive connection, a friction-fit connection, a welded connection, or the like.

During operation, the liquid pump chamber 328 is primed by moving piston 330 outward to expand liquid pump chamber 328 and draws liquid in from container 312 past liquid inlet wiper seal 382 into pump chamber 328. In some embodiments, a biasing member (not shown), such as, for example, a spring, is used to move piston 330 outward to expand liquid pump chamber 328. Once liquid pump chamber 328 is primed, the liquid pump 320 is ready for to dispense. Piston 330 is moved forward. Liquid inlet wiper valve 382 prevents liquid from flowing back into container 312 and the liquid from liquid pump chamber 228 is forced to flow past liquid outlet wiper valve 284 into the liquid staging area 325 and through apertures 392 into the interior of valve body 380, through outlet 399 and through outlet nozzle 360.

Figure 4:
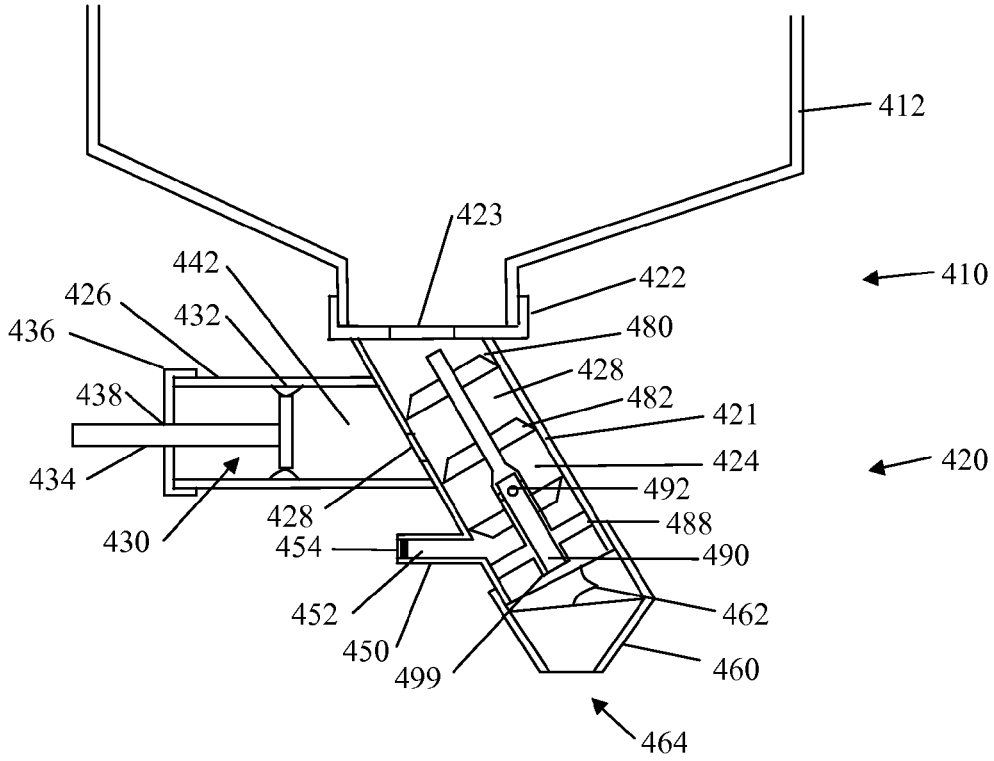
FIG. 4 is a partial cross-section of another refill unit with yet another exemplary foam pump and an off-set outlet nozzle.

FIG. 4 is a cross-sectional view of an exemplary embodiment of a refill unit 410 suitable for use in foam dispensers, such as foam dispenser 100. Foam pump 420 includes a closure 422 for connecting foam pump 420 to container 412. Closer 422 may be connected to container 412 by any means, such as, for example, a snap fit connection, a threaded connection, an adhesive connection, a welded connection or the like. Closure 422 includes a liquid inlet aperture 423. Foam pump 420 also includes a valve cavity housing 421 secured to closure 422. Valve cavity housing 421 is at least partially cylindrical.

Valve cavity housing 421 is placed at an angle allowing the liquid inlet aperture 423 and foam outlet 464 to be off-set. Thus, this exemplary embodiment allows a container 412 to have a neck 413 that is in the center of the container 412 and have a foam outlet 464 that is located closer to the front of the dispenser (not shown). Locating the neck 413 of the container 412 in the center of the container 412 allows the container walls to be more uniform and helps to eliminate blow mold lines that occur with a neck that is off-set from the center of the container. Having an outlet 464 closer to the front of the dispenser allows for better placement of the foam in a user's hand.

Extending outward from valve cavity housing 421 is liquid pump cavity housing 426. Liquid pump cavity housing 426 is cylindrical and extends along a horizontal axis. A pump cavity aperture 442 is located through the wall of valve cavity housing 421 placing the interior of liquid pump cavity housing 426 in fluid communication with the interior of valve cavity housing 421 forming a liquid pump chamber 428.

In addition, a cylindrical air inlet housing 450 extends outward from valve cavity housing 421. Located within cylindrical air inlet housing 450 is a passageway 452 to the interior of valve cavity housing 421.

A filter 454 may be included in passageway 452. Filter 454 may be sized, for example, to prevent mold or bacteria in air compressor 456 from being injected into foam pump 420. A releasable connection (not shown) is used to fluidly connect air passage 452 with the outlet of air an air compressor, such as, for example, air compressor 156. The releasable connection allows refill unit 110 to be removed and replaced without removing the air compressor (not shown) from the dispenser housing (not shown). When the refill unit 410 is installed in a dispenser, the air inlet passage 452 connects to the outlet of an air compressor (not shown). Preferably closure 422, valve cavity housing 421, liquid pump cavity housing 426, air inlet housing 450 are made as a single molded piece. However, these components could be made of two or more components.

A valve body 480 is located within valve cavity housing 421. Valve body 480 is stationary. Valve body 480 does not move up and down during operation of foam pump 420. Valve body 480 includes a liquid inlet wiper valve 482, a liquid outlet wiper valve 484, an air inlet wiper valve 486 and a stabilizing ring 488. Valve body 480 includes a hollow interior portion 490 and one or more apertures 492 that connect the hollow interior portion 490 to the mixing chamber 496. Valve body 480 also includes a liquid outlet 499.

The area between liquid inlet wiper valve 482, liquid outlet wiper valve 484 and piston 430, including the interior of pump housing 426 form liquid pump chamber 428. The area between liquid outlet wiper valve 486 and stabilizing ring 488 is a liquid staging area. The area between the liquid outlet 499, air inlet wiper valve 486 and mix media 462 form a mixing chamber 424.

Stabilizing ring 488 holds valve body 480 in place and also forms a seal between valve body 480 and valve cavity housing 421. Stabilizing ring 488 seals the upper portion of valve cavity housing 421 from air and prevents fluid from the liquid staging area from traveling down into the air inlet passage 452.

Foam pump 420 also includes an outlet nozzle 460. Outlet nozzle 460 is secured to valve cavity housing 421. Outlet nozzle 460 may be secured to valve cavity housing 421 by any means, such as, for example, a snap-fit connection, a threaded connection, an adhesive connection, a friction-fit connection, a welded connection, or the like. Outlet nozzle 460 includes one or more mix media 462. Mix media 462 may be screens (as illustrated) or other porous members or baffles that agitate the liquid air mixture to create foam. Operation of foam pump 420 is similar to operation of foam pump 120 described above.

Figure 5:
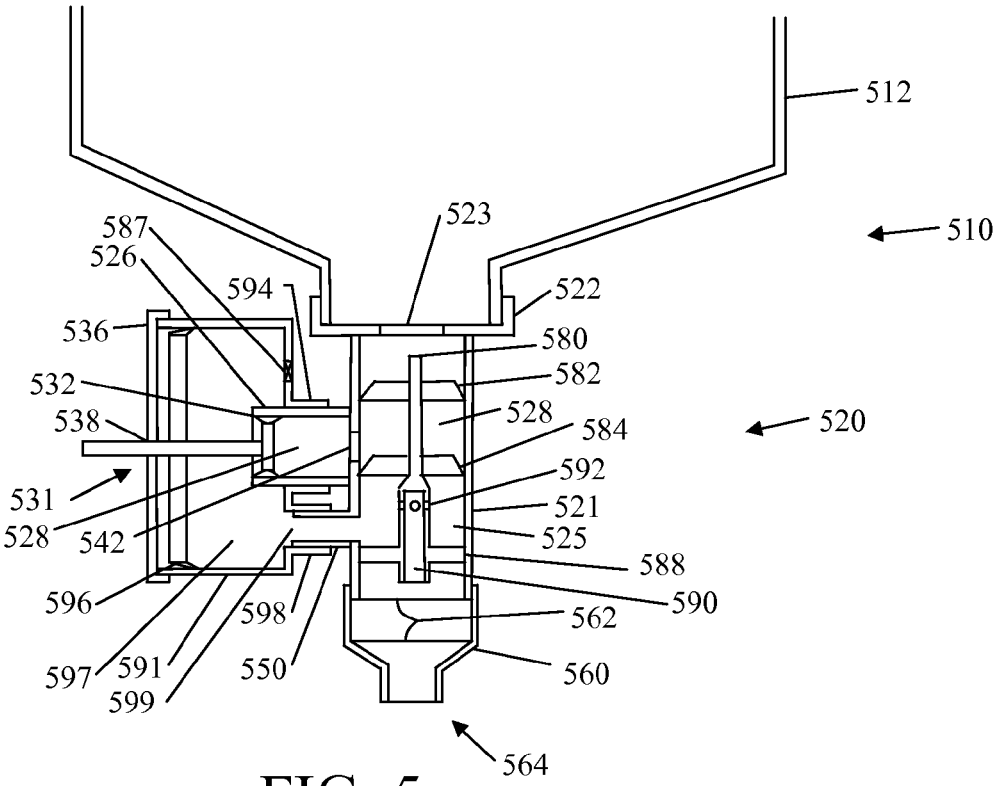
FIG. 5 is a partial cross-section of another refill unit with yet another exemplary foam pump.

FIG. 5 is a cross-sectional view of an exemplary embodiment of a refill unit 510 suitable for use in foam dispensers. Refill unit 510 includes an integrated foam pump 520. Integrated foam pump 520 includes a liquid pump portion and an air compressor portion Foam pump 520 includes a closure 522 for connecting foam pump 520 to container 512. Closer 522 may be connected to container 512 by any means, such as, for example, a snap fit connection, a threaded connection, an adhesive connection, a welded connection or the like. Closure 522 includes a liquid inlet aperture 523. Foam pump 520 also includes a valve cavity housing 521 secured to closure 522. Valve cavity housing 521 is at least partially cylindrical.

Extending outward from valve cavity housing 521 is liquid pump cavity housing 526. Liquid pump cavity housing 526 is cylindrical and extends along a horizontal axis. A pump cavity aperture 542 is located through the wall of valve cavity housing 521 placing the interior of liquid pump cavity housing 528 in fluid communication with the interior of valve cavity housing 521.

In addition, a cylindrical air inlet housing 550 extends outward from valve cavity housing 521. Located within cylindrical air inlet housing 550 is a passageway to the interior of valve cavity housing 521. Preferably closure 522, valve cavity housing 521, liquid pump cavity housing 526, air inlet housing 550 are made as a single molded piece. However, these components could be made of two or more components.

An air compressor housing 591 is secured to valve cavity housing 521. Air compressor housing 591 includes a first cylindrical extension 594 that is sized to fit over cylindrical liquid pump cavity housing 526 and a second cylindrical extension 598 sized to fit over cylindrical air inlet housing 550. The first cylindrical extension 594 and second cylindrical extension 598 are secured to liquid pump cavity housing 536 and air inlet housing 550 by any means, such as, for example, a friction fit connection, a snap fit connection, an adhesive connection, a welded connection or the like. Air compressor housing 591 includes a one-way air inlet valve 587 for allowing air to enter air chamber 597 to prime air chamber 597.

A dual piston 531 having an air piston 596 and a liquid piston 532. Air piston 596 is located within air compressor housing 591. Air piston 596 engages the inside wall of air compressor housing 591 and forms compressible air chamber 597. A cap 536 is connected to air compressor housing 591. Cap 536 includes an aperture for the stem of dual piston 531 to pass through. Aperture 538 also provides a guide for dual piston 531. Air piston 596 and liquid piston 532 are connected together. Liquid piston 532 engages with pump cavity housing 526 to form part of liquid pump chamber 528.

A valve body 580 is located within valve cavity housing 521. Valve body 580 is stationary. Valve body 580 does not move up and down during operation of foam pump 520. Valve body 580 includes a liquid inlet wiper valve 582, a liquid outlet wiper valve 584 and a stabilizing ring 588. Valve body 580 includes an hollow interior portion 590 and one or more apertures 592 that connect the hollow interior portion 590 to the mixing chamber 596.

The area between liquid inlet wiper valve 582, liquid outlet wiper valve 584 and liquid piston 532, including the interior of liquid pump housing 526 form liquid pump chamber 528. The area between liquid outlet wiper valve 584, stabilizing ring 588 and mix media 562 form a mixing chamber 524. Stabilizing ring 588 holds valve body 580 in place and also forms a seal between valve body 580 and valve cavity housing 521.

Foam pump 520 also includes an outlet nozzle 560. Outlet nozzle 560 is secured to valve cavity housing 521. Outlet nozzle 560 may be secured to valve cavity housing 521 by any means, such as, for example, a snap-fit connection, a threaded connection, an adhesive connection, a friction-fit connection, a welded connection, or the like. Outlet nozzle 560 includes one or more mix media 562. Mix media 562 may be screens (as illustrated) or other porous members or baffles that agitate the liquid air mixture to create foam.

During operation, the liquid pump chamber 528 is primed by moving liquid piston 532 outward to expand liquid pump chamber 528 and draw liquid in past liquid inlet wiper seal 582 into liquid pump chamber 528. Simultaneously air piston 596 is moved outward with liquid piston 532 to prime air chamber 597 drawing air in through air inlet valve 587 and outlet 564. In some embodiments, a biasing member (not shown), such as, for example, a spring, is used to move liquid piston 532 and air piston 596 outward to expand liquid pump chamber 528.

Once liquid pump chamber 528 and air chamber 597 are primed, the foam pump 520 is ready for to dispense. Dual piston 531 is moved inward. Liquid inlet wiper valve 582 prevents liquid from flowing back into container 512 and the liquid from liquid pump chamber 528 is forced to flow past liquid outlet wiper valve 584 into the mixing chamber 544.

Air from air chamber 597 travels into mixing chamber 544 and mixes with the liquid. The air and liquid mixture is forced through aperture 592, through hollow interior portion 590, through the mix media 562 and is dispensed out of outlet 564 in the form of a foam.

While the present invention has been illustrated by the description of embodiments thereof and while the embodiments have been described in considerable detail, it is not the intention of the applicants to restrict or in any way limit the scope of the appended claims to such detail. Additional advantages and modifications will readily appear to those skilled in the art. Moreover, elements described with one embodiment may be readily adapted for use with other embodiments. Therefore, the invention, in its broader aspects, is not limited to the specific details, the representative apparatus and illustrative examples shown and described. Accordingly, departures may be made from such details without departing from the spirit or scope of the applicants' general inventive concept.

We claim:

1. A foam pump comprising:

a pump housing;

a valve cavity housing;

a liquid inlet in the valve cavity housing;

a unitary valve body located within the valve cavity housing;

the unitary valve body having a liquid inlet wiper valve; a liquid outlet wiper valve; an air inlet wiper valve; a hollow interior portion, an opening through the valve body into the hollow interior portion, and an outlet opening;

a pump chamber;

a pump chamber opening through the valve cavity;

the pump chamber opening located between the liquid inlet wiper valve and the liquid outlet wiper valve, wherein the pump chamber opening places the interior of the valve cavity housing in fluid communication with the interior of the pump chamber;

an air inlet into the valve cavity housing;

a mixing chamber located at least partially within the valve cavity;

a mix media located downstream of the mixing chamber; and an outlet nozzle.

2. The foam pump of claim 1 wherein the unitary valve body further comprises a stabilizing ring, wherein the stabilizing ring forms a seal against the valve cavity housing and prevents fluid flow past the stabilizing ring.

3. The foam pump of claim 1 wherein the opening through the valve body is located in the mixing chamber.

4. The foam pump of claim 1 wherein a longitudinal axis of the unitary valve body is positioned at an angle that is off-set from a vertical axis so that the outlet nozzle is off-set from the liquid inlet.

5. A foam pump comprising:

a pump housing;

a valve cavity housing;

a liquid inlet in the valve cavity housing;

a unitary valve body located within the valve cavity housing;

the unitary valve body having a liquid inlet wiper valve, and a liquid outlet wiper valve, and an air inlet wiper valve;

a pump chamber;

a pump chamber opening through the valve cavity;

the pump chamber opening located between the liquid inlet wiper valve and the liquid outlet wiper valve, wherein the pump chamber opening places the interior of the valve cavity housing in fluid communication with the interior of the pump chamber;

an air inlet into the valve cavity housing;

a mixing chamber located at least partially within the valve cavity;

a mix media located downstream of the mixing chamber; and an outlet nozzle.

6. The foam pump of claim 5 wherein the unitary valve body further comprises a stabilizing ring, wherein the stabilizing ring forms a seal against the valve cavity housing and prevents fluid flow past the stabilizing ring.

7. The foam pump of claim 5 wherein the unitary valve body further comprises a hollow interior portion, an outlet and an opening through the valve body placing the mixing chamber in fluid communication with the hollow interior portion of the valve body.

8. The foam pump of claim 5 wherein a longitudinal axis of the unitary valve body is positioned at an angle that is off-set from a vertical axis so that the outlet nozzle is off-set from the liquid inlet.

9. The foam pump of claim 5 further comprising a filter in fluid communication with the air inlet.

10. A pump comprising:

a pump housing;

a valve cavity housing;

a liquid inlet in the valve cavity housing;

a unitary valve body located within the valve cavity housing;

the unitary vale body having a liquid inlet wiper valve; a liquid outlet wiper valve; an air inlet wiper valve; a hollow interior portion, an opening through the valve body into the hollow interior portion, and an outlet opening;

a pump chamber;

a pump chamber opening through the valve cavity;

the pump chamber opening located between the liquid inlet wiper valve and the liquid outlet wiper valve, wherein the pump chamber opening places the interior of the valve cavity housing in fluid communication with the interior of the pump chamber; and an outlet nozzle.

11. The pump of claim 10 further comprising an air inlet into the valve cavity housing and wherein the unitary valve body further comprises a stabilizing ring, wherein the stabilizing ring forms a seal against the valve cavity housing and prevents fluid from flowing past the stabilizing ring.

12. The pump of claim 10 further comprising an air inlet into the valve cavity housing.

13. The pump of claim 10, wherein the air inlet wiper seal valve allows air to flow in a direction that opposes the direction of the liquid flow through the liquid inlet wiper valve and the liquid outlet wiper valve.

14. The pump of claim 1, wherein the air inlet wiper valve allows air to flow in a direction that opposes the direction of the liquid flow through the liquid inlet wiper valve and the liquid outlet wiper valve.

15. The pump of claim 5, wherein the air inlet wiper valve allows air to flow in a direction that opposes the direction of the liquid flow through the liquid inlet wiper valve and the liquid outlet wiper valve.

* * * * *